US010670376B2

(12) United States Patent
Grundner et al.

(10) Patent No.: US 10,670,376 B2
(45) Date of Patent: Jun. 2, 2020

(54) METHOD AND DEVICE FOR PROVIDING A DUMMY TARGET FOR PROTECTING A VEHICLE AND/OR AN OBJECT FROM RADAR-GUIDED SEEKER HEADS

(71) Applicant: RHEINMETALL WAFFE MUNITION GMBH, Unterluess (DE)

(72) Inventors: Lukas Grundner, Saalfelden am Steinernen Meer (AT); Thomas Macher, Freilassing (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 298 days.

(21) Appl. No.: 15/695,246

(22) Filed: Sep. 5, 2017

(65) Prior Publication Data

US 2018/0023928 A1 Jan. 25, 2018

Related U.S. Application Data

(63) Continuation of application No. PCT/EP2016/054521, filed on Mar. 3, 2016.

(30) Foreign Application Priority Data

Mar. 5, 2015 (DE) ..... 10 2015 002 737

(51) Int. Cl.
*F41H 11/02* (2006.01)
*F41G 7/22* (2006.01)
(Continued)

(52) U.S. Cl.
CPC ..... *F41H 11/02* (2013.01); *F41G 3/04* (2013.01); *F41G 7/224* (2013.01); *F41J 2/00* (2013.01)

(58) Field of Classification Search
CPC ..... F41H 11/02; F41H 3/00; F41J 2/00; F41G 7/224; F41G 3/04; B63G 13/00
(Continued)

(56) References Cited

U.S. PATENT DOCUMENTS 5,397,236 A 3/1995 Fegg et al.
5,835,051 A 11/1998 Bannasch et al.
(Continued)

FOREIGN PATENT DOCUMENTS

DE 199 51 767 A1 5/2001
DE 103 46 001 B4 1/2006
(Continued)

OTHER PUBLICATIONS

Ester et al., "A Density-Based Algorithm for Discovering Clusters in Large Spatial Databases with Noise", Second International Conference on Knowledge Discovery and Data Mining (KDD-96), AAAI Press., pp. 226-231.
(Continued)

*Primary Examiner* — Timothy X Pham
(74) *Attorney, Agent, or Firm* — Muncy, Geissler, Olds & Lowe, P.C.

(57) ABSTRACT

A method and a device for providing a dummy target via decoy chaffs for protecting a vehicle and/or an object from radar-guided missiles. After identification of the radar-guided missile and calculation of a decoy chaff pattern, the decoy chaff pattern is presented in the form of polar coordinates in accordance with the firing of shots, a "cut-off" distance for the determination of a defence radius is then found in these polar coordinates. A minimum distance between the disassembly or detonation points within the defence radius is set. The dummy target is then optimized on the basis of the "cut-off" distance and the minimum distance between the disassembly or detonation points. As a result of
(Continued)

this calculation, the only decoy chaffs that are deloyed are those that meet the conditions, i.e. that have a minimum distance between the disassembly or detonation points within the defence radius in the optimized dummy target.

10 Claims, 8 Drawing Sheets

(51) Int. Cl.
*F41G 3/04* (2006.01)
*F41J 2/00* (2006.01)

(58) Field of Classification Search
USPC ..... 342/12
See application file for complete search history.

(56) References Cited

U.S. PATENT DOCUMENTS 6,231,002 B1 * 5/2001 Hibma ..... B64D 7/08 244/3.15
6,513,438 B1 2/2003 Fegg et al.
6,782,826 B1 8/2004 O'Dwyer
7,886,646 B2 2/2011 Bannasch et al.
7,903,019 B2 3/2011 Frick
2005/0001755 A1 * 1/2005 Steadman ..... F41H 11/02 342/14
2007/0159379 A1 * 7/2007 Bannasch ..... F41H 3/00 342/67
2008/0198060 A1 * 8/2008 Shani ..... G01S 7/021 342/14
2012/0210855 A1 * 8/2012 Clark ..... B64D 1/02 89/1.51
2014/0015704 A1 * 1/2014 Huber ..... F41H 3/00 342/9
2016/0010952 A1 * 1/2016 McGeehan ..... F41G 7/224 701/302
2016/0298932 A1 * 10/2016 McGeehan ..... F41G 7/224

FOREIGN PATENT DOCUMENTS

EP 0 597 233 A1 5/1994
EP 1 026 473 A1 8/2000
EP 1 845 332 A1 10/2007
WO WO 01/36896 A1 5/2001

OTHER PUBLICATIONS

International Search Report dated May 6, 2016 (English Translation).

* cited by examiner

METHOD AND DEVICE FOR PROVIDING A DUMMY TARGET FOR PROTECTING A VEHICLE AND/OR AN OBJECT FROM RADAR-GUIDED SEEKER HEADS

This nonprovisional application is a continuation of International application Ser. No. PCT/EP2016/054521, which was filed on Mar. 3, 2016, and which claims priority to German Patent Application No. 10 2015 002 737.9, which was filed in Germany on Mar. 5, 2015, and which are both herein incorporated by reference.

BACKGROUND OF THE INVENTION

Field of the Invention

The invention relates to a method and a device for providing a dummy target for protecting vehicles and objects against radar-guided seeker heads. The invention relates, in particular, to a missile defense at sea for maritime units (ships), such as corvettes, frigates, patrol ships, coast guard ships, supply ships, etc., and also for aircraft and land vehicles and other objects worthy of protection, in particular buildings, military and/or industrial installations, etc.

Description of the Background Art

The threat from missiles having state-of-the-art target seeking systems operating primarily in the radar range (RF) and in the infrared range (IR) continues to increase for ships or other objects. In this case, the missile uses the radar backscatter behavior and also the emission of specific infrared radiations from targets, such as ships, aircraft, tanks, vehicles, etc. for target finding and target tracking. That leads to endeavors to find suitable protective measures against these missiles.

EP 1 026 473 B1, which corresponds to U.S. Pat. No. 5,835,051, discloses a method for providing a dummy target and decoy projectiles that can be used therein, wherein the effective masses are ignited by means of an activation and distribution device in the form of an ignition and expulsion unit arranged centrally in the decoy projectile and, after their ejection, are distributed in the air. For this purpose, the effective masses are arranged one behind another in the longitudinal direction of the projectile.

EP 1 845 332 A1, which corresponds to U.S. Pat. No. 7,903,019, discloses a protective device and a protective measure for a radar system. This active protective measure is effected using passive emitters and/or decoys which operate according to the reflection principle. In that case, a radar apparatus, preferably the ship's own radar, irradiates the decoys. The radiation reflected from the decoys in the direction of the ARM (anti-radiation-missile) in that case has the same characteristic as the direct radiation of the radar itself. As a result, the ARM cannot distinguish whether decoys are involved or the correct radar is involved. The cloud itself directs the ARM away from the target or past the target since the cloud represents a larger object relative to the target and is thus more attractive to the missile.

DE 103 46 001 B4, which corresponds to U.S. Pat. No. 7,886,646, discloses the use of decoys for protecting ships from end-phase-guided missiles. The device proposed here comprises at least one computer, sensors for detecting approaching end-phase-guided missiles, sensors for detecting the approach direction, distance and speed of the missiles, furthermore motion and/or navigation sensors for detecting the ship's own data, at least one firing control computer and at least one decoy launcher which is arranged on the ship and is directable in azimuth and elevation. Decoy patterns suitable for the respective missile type are stored in a database of the computer. Depending on the missile type through to the measured wind direction and wind speed, within a very short time a decoy formation or pattern is generated which is flexible both with regard to shape and size and in respect of deployment distance, deployment altitude, deployment direction and time staggering. Ascertaining the optimum decoy pattern with regard to the number of decoys necessary for missile defense and their spatial and temporal setpoint co-ordinates is carried out in that case depending on the missile and ship data ascertained by the sensors. A decoy pattern formation is spontaneously generated which is flexible taking account of the parameters: type of decoy munitions (IR, RF, IR/RF), number of different types of decoy munitions, time interval between the deployment of the individual decoys, and kinematics of the decoy formation and shape and size of the decoy formation.

The device for its part uses decoy munitions whose generated dummy target diameter corresponds in each case to approximately 10 m to 20 m in order to be able to simulate the spatial signature of the ship to be protected.

SUMMARY OF THE INVENTION

It is therefore an object of the invention to address the problem of demonstrating an optimization for forming an optimized dummy target or an optimized decoy cloud against radar-guided missiles.

The maximum number of dummy targets/decoys for an effective dummy target or an effective decoy cloud is determined by the maximum reflection signature of the object in the individual or respective frequency bands, the aspect angle of the object with respect to the seeking head of the missile, i.e. the inclination and/or the approach angle of the seeking head with respect to the object, and the size of the object, etc. In practice, therefore, the maximum required number of decoys for a decoy cloud/dummy target for protecting a frigate differs from the required number for an effective dummy target for protecting a corvette, etc.

Therefore, the invention is based on the concept that when firing the decoys in so-called volleys from a decoy launch system (DLS) comprising one and/or a plurality of launcher (s), the number of volleys and also the number of decoys to be fired per volley can be freely defined by the user. In this case, the free definition is effected depending on the size of the object to be protected and the missile type. This possibility for variation of the number of volleys and also the number of decoys to be deployed within the volley(s) results in an optimization of the protective measure by the optimized deployment of decoys/dummy targets. The method provided operates at the operation time or in real time taking account of environmental influences such as course and speed of the object, wind direction, wind speed, speed and approach angle of the radar-guided missile. The decoy cloud or the dummy target itself has chaff material and flares (IR), which are in turn constituted from burning red phosphorus.

The envisaged optimization is subject here to at least two conditions and concerns in particular the optimization of the maximum number of dummy targets/decoys required for forming the decoy cloud. In other words, as a result of the optimization, only as many decoys as are required for forming the dummy target and/or only the decoys that are required for forming the dummy target are fired.

A condition is that the decoys which upon firing would be fired or ejected too far away from the target (from the viewpoint of the missile) or the object to be protected (from the viewpoint of the DLS) are not fired. This is intended to prevent decoys from being deployed into regions in which protection from the attacking missile is no longer effective ("cut-off" condition). A further condition is that the decoys must not be too close to one another in the effective region, i.e. in the region in which protection by the decoys is classified as effective (minimum distance condition). This measure is intended to avoid a disadvantage which is known in practice and which arises if the disintegration or detonation points of the decoys are too close to one another. If the disintegration or detonation points of the decoys in the formation of the decoy cloud are too close to one another, i.e. the dummy targets overlap, this results in a coupling and, in association therewith, a weakening of the effect of the individual decoys. The minimum distances between the decoys are in turn dependent on the munition or the decoys which is/are used or fired for forming the decoy cloud. Given a generated dummy target diameter of approximately 18 m, therefore, the minimum distance condition will be 18 m, while given a generated dummy target diameter of approximately 10 m, the minimum distance condition is only 10 m. The minimum distance thus depends on the diameter of the munitions used/decoy used.

The method is based on a specific succession or sequence in the launcher system that determines or calculates the firing of the decoys of the directable launch system, for example of a two-axis decoy launch system with parameters that can be defined by the user. The calculation of the corresponding shot solution is carried out at the operation time and is forwarded as the result to a programmable logic controller (PLC) of the decoy launch system (DLS), in the case of directable launchers for launcher alignment (e.g.: in azimuth and/or elevation) and initiation of the decoys within the magazines of the DLS and, in the case of non-directable launchers, only for initiation of the decoys within the magazines of the DLS.

As customary in practice, the protective measure—formation of a decoy cloud—is initiated after detection of an attack by a radar-guided missile. With regard to the sequence of detection, etc., reference is hereby made explicitly to DE 103 46 001 B4, which corresponds to U.S. Pat. No. 7,886,646 and is incorporated herein by reference.

After detection, the radar-guided missile is identified. By way of example, an ESM system (electronic support measures) can be used for identifying such missiles, which system can pick up the radar signal (frequency, signal waveform, etc.) of the seeker head of the missile. In this case, recourse is had to the fact that each radar seeker head has its own specific signature. In order to determine the type of seeker head, the information obtained is compared with values stored in a database of the ESM system. The information obtained here is forwarded to the DLS either directly or via a combat management system (CMS). The DLS likewise has a database containing relevant information of the missiles and compares that with the communicated information. The DLS, for its part, in reaction to the knowledge of the missile type, specifies a decoy pattern with the disintegration or detonation points of the decoys present in the DLS in a decoy pattern in accordance with the firing of shots after calculation. This representation of the disintegration or detonation points takes place in a polar co-ordinate system. A first step for optimizing the decoy cloud involves ascertaining or defining a radius, a so-called protective or effective radius, around the object/target to be protected. This radius is calculated or defined and is determined from the maximum search radius of the radar lobe of the attacking missile or seeker. After knowledge or definition of the effective radius, a second step then involves ascertaining the decoys which would lie within the radius upon formation of the decoy cloud. This also involves checking which of the decoys would overlap in terms of their effect upon being deployed. In order to generate an optimum effect of the decoy cloud, the distances between the disintegration or detonation points must not fall below a specific value. Said distance, as already explained, is dependent on the diameter of the dummy target being formed. Therefore, in order to avoid an excessively small distance between the disintegration or detonation points, a distance that is freely defined for the user is taken into account as minimum distance between the points. If this distance is undershot when the disintegration or detonation points are ascertained, these corresponding disintegration or detonation points are discarded.

As a result, the decoy cloud optimized in this way provides for the targeted use of a portion of the decoys of the DLS, while the discarded decoys are not deployed. This result is fed to the PLC of the DLS and the decoys required for forming the decoy cloud against the radar-guided missile are correspondingly ignited.

A tactically expedient solution is thus calculated taking account of relative wind drift, seeker head information, missile speed, distance and approach angle (aspect angle). The result is a list of X/Y co-ordinates for which, as a consequence of the calculation, an appropriate position for the decoy cloud is found for a given Z co-ordinate. In this case, the calculation under the predefined conditions is repeated until a physically realizable condition for the dummy target results and the DLS can produce this dummy target.

A method is proposed, in particular, in which after identifying the radar-guided missile and calculating a decoy pattern, in accordance with the firing of shots, the decoy pattern is represented as a point cloud of the disintegration or detonation points of the dummy target in the form of polar co-ordinates. In these polar co-ordinates, a "cut-off" distance for determining a defense radius is then ascertained or defined and a minimum distance between the disintegration or detonation points within the defense radius is defined in a freely selectable manner. Optimizing the dummy target is then effected on the basis of the "cut-off" distance and the minimum distance between the disintegration or detonation points. As a result of this calculation, the decoys ejected are only the ones which fulfill the conditions, i.e. which have the minimum distance between the disintegration or detonation points within the defense radius in the optimized dummy target. The others are discarded.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
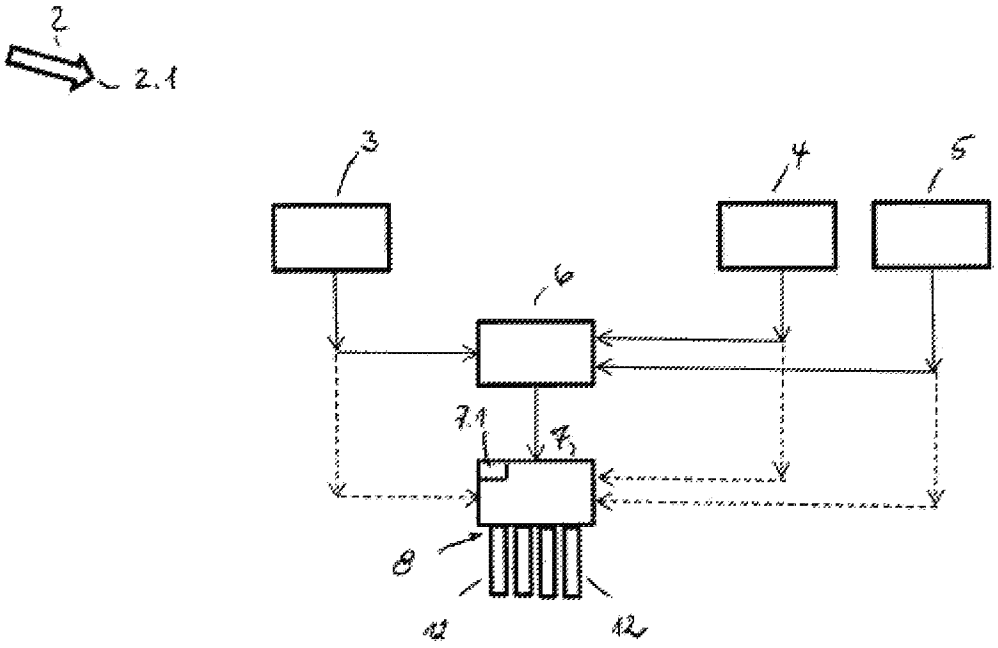
FIG. 1 shows, in a block diagram illustration, an assembly of a protective device against radar-guided missiles.

FIG. 1 illustrates the essential assemblies of a protective device 100 for protecting an object 1 (FIG. 5), here a ship, against radar-guided missiles 2. The protective device 100 comprises at least one sensor 3 for recognizing or identifying the missile 2 and various sensors 4, 5, etc., which supply ambient data, etc. Components that detect a missile 2 attacking the object 1 are not illustrated in more specific detail, since such components or sensors are known.

The sensor 3 is preferably an ESM system that can pick up the radar signal (frequency, signal waveform) of the seeker head 2.1 of the missile 2. With the aid of a database stored in the ESM system, the missile type of the missile 2 is ascertained in an evaluation. The sensor or sensors 4 supply the environmental data such as wind direction, wind speed, etc. The navigation data of the ship are contributed via the sensor 5. Incorporating and taking account of such information for providing a decoy cloud is known as such, reference being made explicitly to DE 103 46 001 B4, to which reference is hereby made.

The protective device 100 furthermore comprises at least one decoy launch system (DLS) 7 which, for its part, has at least one launcher 8. However, the DLS 7 can also have two or a plurality of launchers 8, which are likewise directable or non-directable in azimuth and/or elevation. Preference is given to four launchers 8 (FIG. 6) each having eight magazines 12, said launchers being incorporated on the object 1. The DLS 7 comprises a firing control system (not illustrated in more specific detail), to which the ship's systems (e.g.: CMS, ESM, various sensors) and the control unit of the DLS 7 or of the launchers 8 are electronically connected. This connection is used to carry out the transmission of the control signals for directing the launcher(s) 8 (actuating signals in azimuth and/or elevation) of the DLS 7 and the signals for initiating the decoys 9 for forming a decoy cloud 10, said decoys being situated in the DLS 7 or in the launchers 8.

A database 7.1 is implemented in the DLS 7, information about a multiplicity of known radar seeker heads being stored in said database. The DLS 7 is electronically linked to the ESM system 3 directly or via a CMS (combat management systems) 6. Said CMS 6 has the ability to take into consideration and evaluate all information of the sensors 3, 4, 5 and assemblies on the ship together in real time and to forward these evaluations. With omission of the CMS 6, this task is performed by the firing control system of the DLS 7. The DLS 7 is equipped with eight magazines 12 (12.1-12.4) in the present exemplary embodiment. However, this number of eight magazines 12 should not be regarded as limiting.

Figure 2A:
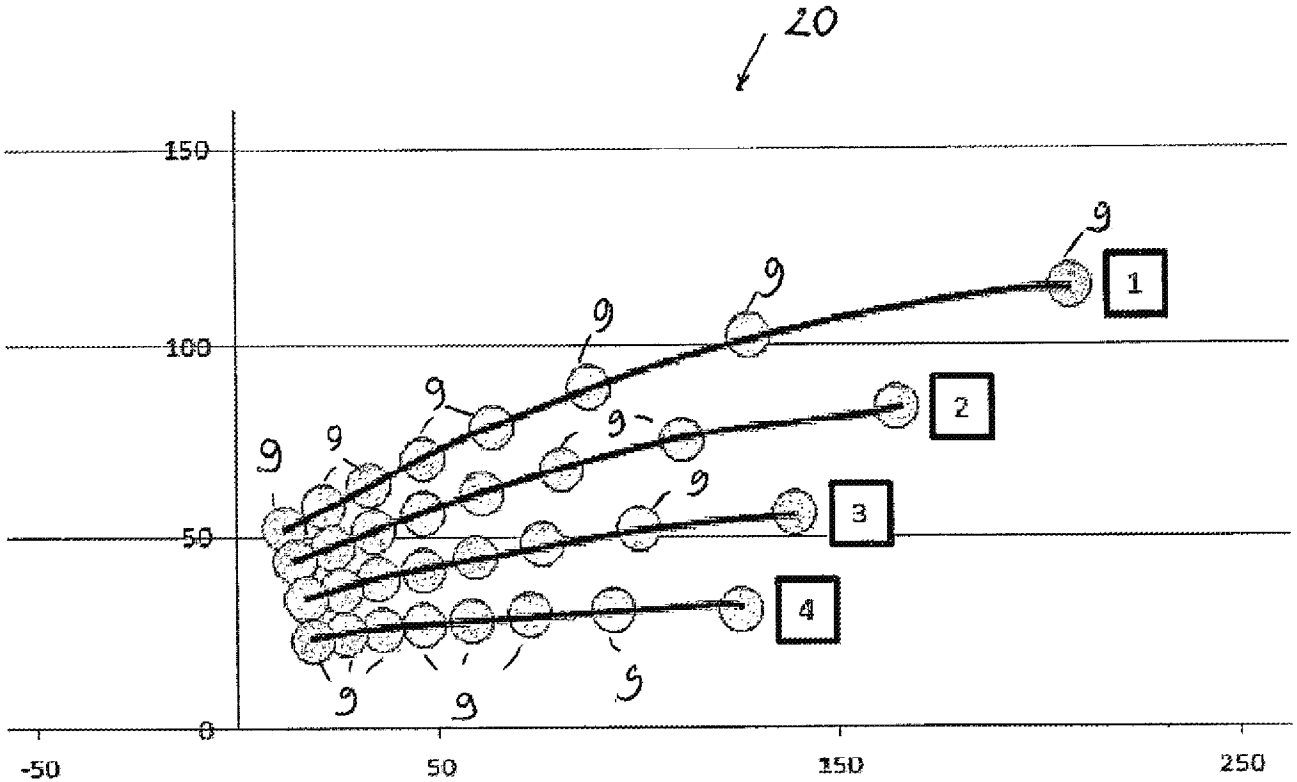
FIGS. 2*a, b* show an illustration of the decoys deployed in volleys.
Figure 2B:
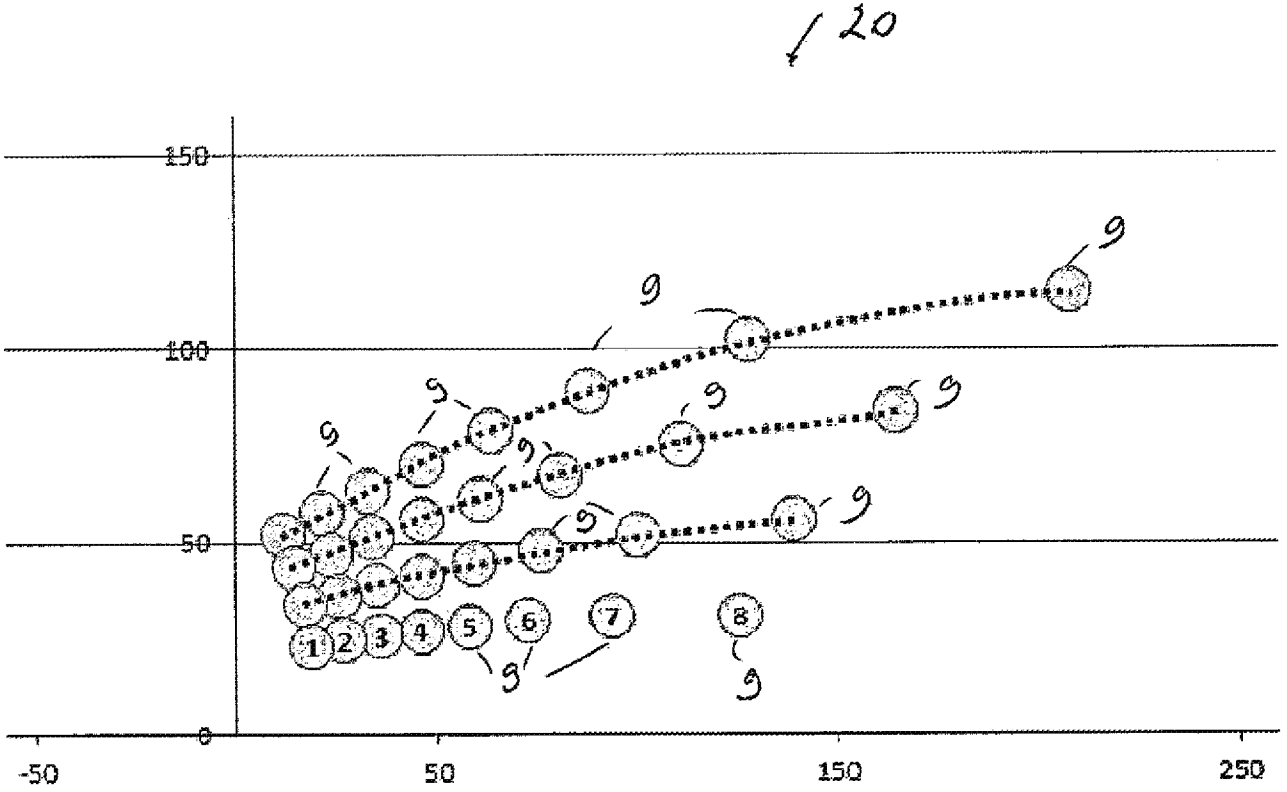

The method proceeds as follows:

Upon detection of the missile 2, the sensor 3 performs the identification of the missile 2. After identification, this information is transferred to the CMS 11, which also picks up the data of the sensors 4, 5. In co-ordination with the data of the sensors 4, 5, the DLS 7 offers a decoy pattern (point cloud) 20 (FIGS. 2*a*, 2*b*).

In the firing control system of the DLS, the deployment of the decoys 9 is then optimized, which involves determining at the operation time the required length of a volley and how many decoys 9 are intended to be deployed or ignited per volley. The number of volleys and the number of decoys 9 per volley are freely definable by the user and emerge from the object to be protected.

This calculation of the required decoys 9 for the optimized decoy cloud 10 is carried out both in an X-Y co-ordinate system (for the minimum distance condition) and in the form of polar co-ordinates ("cut-off" condition) in order to generate a point cloud 20 and thus to be able to perform the optimization more effectively. The optimized point cloud 20, for its part, then lies within a radar lobe (dashed line) defined depending on the missile 2.

In the firing control system of the DLS 7, the point cloud is optimized with the aid of a cluster analysis of the point cloud 20. One known analysis here is the DBSCAN (source: Ester, Martin; Kriegel, Hans-Peter; Sander, Jörg; Xu, Xiaowei (1996). Simoudis, Evangelos; Han, Jiawei; Fayyad, Usama M., eds. "A density-based algorithm for discovering clusters in large spatial databases with noise". Proceedings of the Second International Conference on Knowledge Discovery and Data Mining (KDD-96). AAAI Press. pp. 226-231). The point cloud 20 is optimized with the result of the cluster analysis.

FIGS. 2*a*, 2*b* show the firing of the decoys 9 in a number of four volleys [1] to [4], wherein eight decoys 9 can be fired per volley. For the purpose of firing the four volleys [1] to [4], the at least one DLS 7 has eight magazines 12, in each of which four decoys 9 are introduced. That yields 32 dummy targets as overall dummy target for the present exemplary embodiment. FIGS. 2*a*, 2*b* here illustrate the viewpoint of a pattern (decoy pattern 20) from the approaching radar-guided missile 2 without optimization. Given a predefined minimum number of dummy targets (results from the value of the ship's signature to be complied with) for example of 20 dummy targets (for a frigate) which have to be deployed in order to guarantee protection of the object 1, the latitude for the optimization is then between 20 and 32 dummy targets.

Figure 3A:
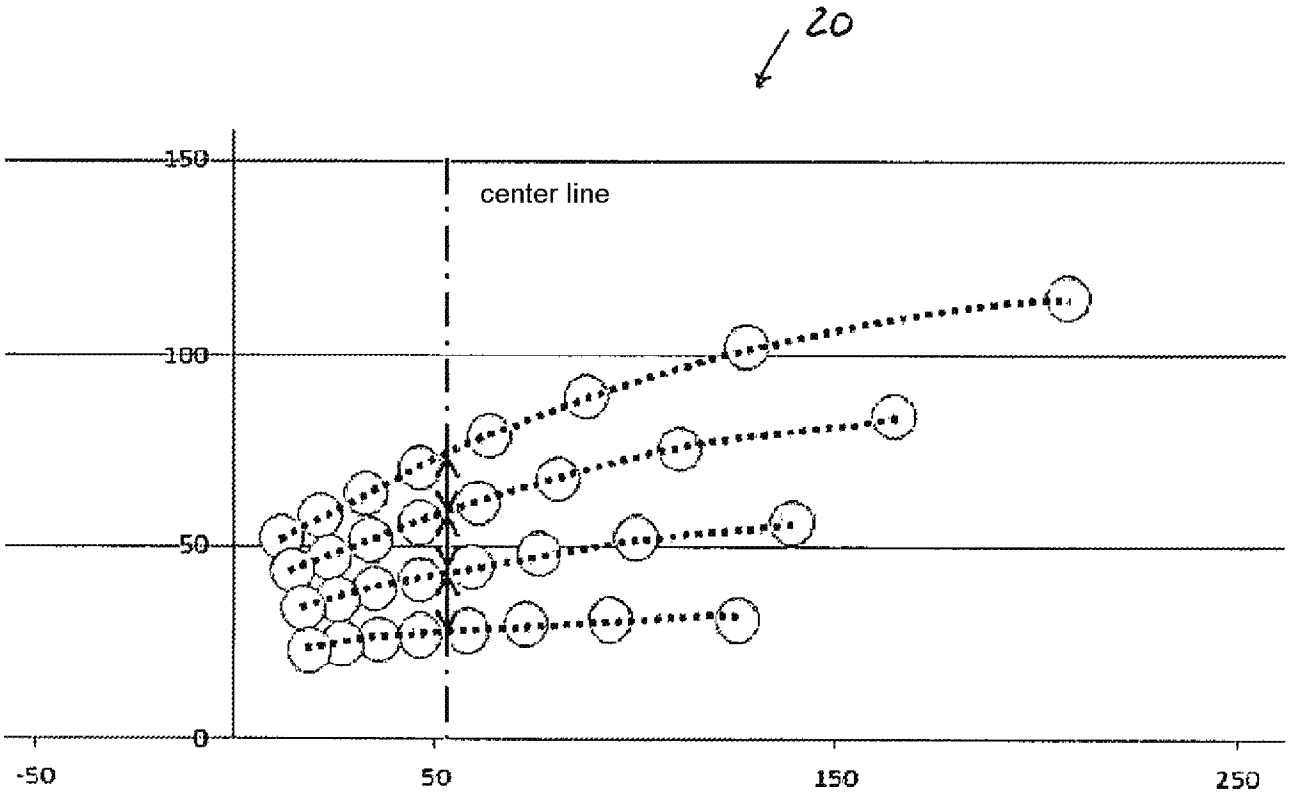
FIGS. 3*a, b*, 4*a, b* show an illustration of the optimization sequence for deploying the decoys.
Figure 3B:
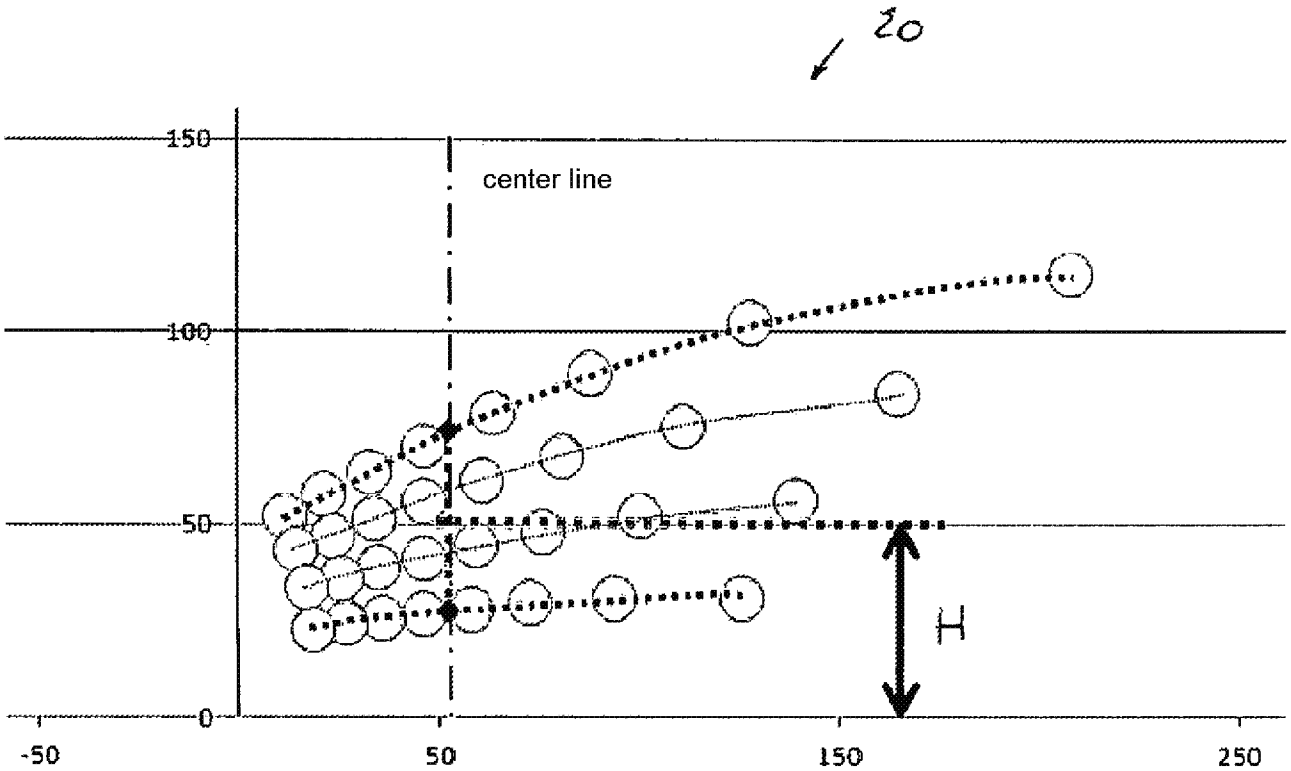

In order to optimize the dummy targets in accordance with FIG. 3*a*, a vertical distance between two successive volleys is freely defined by the user. The vertical distance is measured in the center of the volley. The center of the volley is determined by half the distance between the outer right-hand and outer left-hand magazines 12. The height of the center of the point cloud 20 (decoy pattern) is then freely defined (FIG. 3*b*). The height H is ascertained as the average value of the heights of the highest volley [1] and the lowest volley [4]. The height of a volley is defined as the horizontal midpoint of a volley, measured from the center of the volley. The center of the volley is determined by half the angle of the outermost right-hand 12.1 and the outermost left-hand 12.4 magazine 12.

Figure 4A:
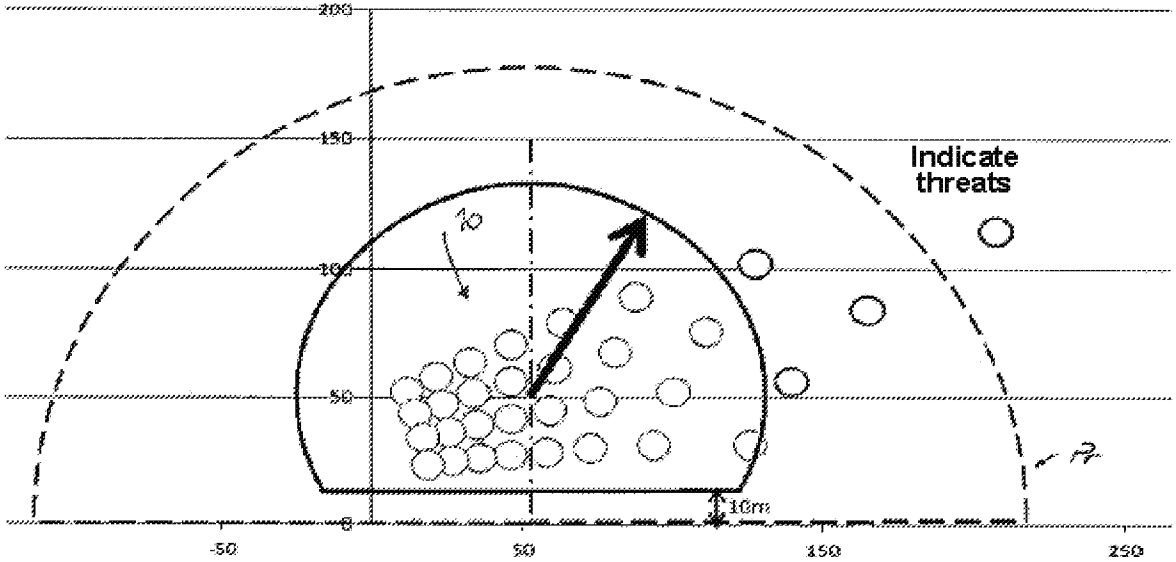

On the basis of these values, a polar co-ordinate radius (defense radius) $P_r$ is then subsequently defined, i.e. the "cut-off" distance, i.e. that distance from the midpoint of the point cloud 20 within which a threat from the ascertained missile 2 is to be expected. Disintegration or detonation points of the individual decoys 9 which lie outside this defined radius $P_r$ are not taken into account further in the calculation, rather they are discarded. The representation of this distance in polar co-ordinates (also circular co-ordinates) has a major advantage over a representation in Cartesian co-ordinates. Specifically the so-called radar lobe of a radar-guided missile 2 corresponds in cross section to the dashed line illustrated in FIG. 4*a*. If the disintegration or detonation points of the individual decoys 9 are situated within said radar lobe, a corresponding effect of the dummy target or of the decoy cloud 10 is guaranteed.

Figure 4B:
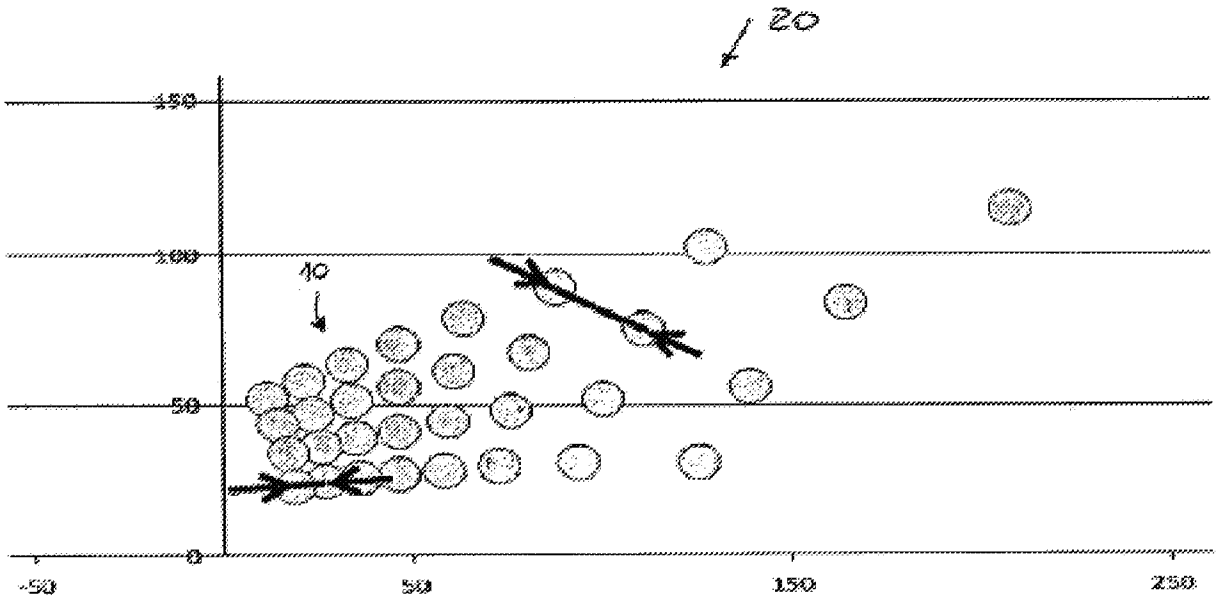

The effect of the dummy target is furthermore impaired by the respective distance between the individual disintegration or detonation points. In order to generate an optimum effect of the dummy target or of the decoy cloud 10, the distances between the disintegration or detonation points must not fall below a specific value. The disintegration or detonation points are at a specific distance from one another in accordance with the firing of shots after calculation. Said distance can vary according to the flight angle of the radar-guided missile 2. In order to avoid an excessively small distance between the disintegration or detonation points, a distance that is freely defined for the user is taken into account as minimum distance between the points. In this case, the distance to be defined is to be measured from the viewpoint of the radar-guided missile 2. If this distance is undershot when the disintegration or detonation points are ascertained, these corresponding disintegration or detonation points are discarded by the calculation algorithm (FIG. 4*b*).

The DBSCAN, a cluster algorithm, is used as a calculation algorithm for recognizing an undershooting of the minimum distance between the disintegration or detonation points. A cluster recognition is intended to be performed with the aid of the DBSCAN.

The results of the DBSCAN are used to thin out clusters of the dummy target or of the decoy cloud 10 from the outside inward, in combination with the definition of the "cut-off" distance. In this case, the number of disintegration or detonation points discarded and decoys 9 dispensed with is as few as possible but as many as necessary. At the operation time, environmental influences such as course and speed of the object 1, and wind direction, wind speed, speed and approach angle of the radar-guided missile 2 are taken into account in the calculation. The resultant dummy target or the resultant and optimized decoy cloud 10 is always calculated as far as possible at right angles to the threat (approach angle of the radar-guided missile 2 relative to the object 1). The result of the calculation is forwarded to the PLC of the DLS 7, which then performs the firing of the individual decoys 9 and the directing of the DLS 7 or the launcher thereof in the axes (FIG. 5).

Figure 5:
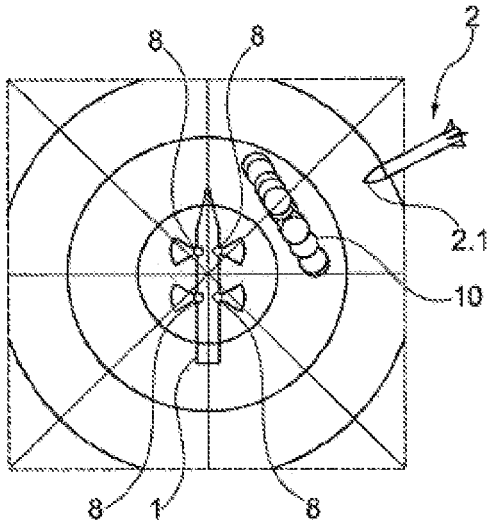
FIG. 5 shows a view from above given an approach direction of 60° from the north.

The method for optimizing the decoy cloud 10 with respect to the missile 2 itself also takes effect given a plurality of launchers 8 of a DLS 7, which then produce in co-operation the desired dummy target or decoy cloud 10 (FIG. 5). To that end, all the launchers 8 of the DLS 7 report their achievable disintegration or detonation points for the corresponding volley. All the disintegration or detonation points are used for the "cut-off" and the minimum distance condition. This results in a reduction of the number of necessary and possible disintegration or detonation points.

In addition, a check of the munition minimum condition for the total number of defined disintegration or detonation points (volley x number of decoys per volley) is also carried out here. If the number of disintegration or detonation points that remained is higher than the required number, the "cut-off" condition and the minimum distance condition (up to max. 18 m) are correspondingly reduced alternately until the required number of disintegration or detonation points (predefined number of dummy targets) is attained. If e.g. 40 disintegration or detonation points are attainable, but 32 are desired and 20 are required as a minimum, then an optimization of the decoy cloud or of the dummy target between 32 and 20 is carried out. This possibility of optimization also holds true for an individual launcher of the DLS 7.

Figure 6:
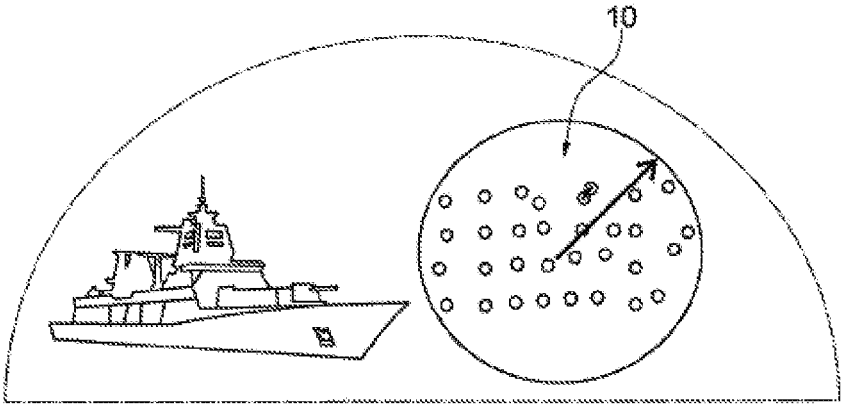
FIG. 6 shows a view from the viewpoint of the decoy in accordance with the illustration in FIG. 4*a*.

A dummy target cloud for the object 1 to be protected as illustrated in FIG. 6 arises as the result of the optimization.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for providing a dummy target via decoys for protecting a vehicle and/or object from radar-guided missiles, the method comprising:

detecting an attack by a radar-guided missile;

identifying the radar-guided missile;

calculating a decoy pattern in accordance with a firing of shots;

representing the decoy pattern as a point cloud of a disintegration or detonation point of the dummy target in a form of polar co-ordinates;

ascertaining or defining a cut-off distance for determining a defense radius;

defining a minimum distance between the disintegration or detonation points within the defense radius;

optimizing the dummy target based on the cut-off distance and the minimum distance between the disintegration or detonation points; and deploying only the decoys that have the minimum distance between the disintegration or detonation points within the defense radius in the optimized dummy target.

2. The method as claimed in claim 1, wherein a cluster recognition of the point cloud having the disintegration or detonation points in the decoy pattern is carried out by a cluster algorithm.

3. The method as claimed in claim 1, wherein recognized clusters of the dummy target are thinned out from an outside inward.

4. The method as claimed in claim 1, wherein the dummy target is ascertained at substantially right angles to a threat or an approach angle of the radar-guided missile relative to the object.

5. The method as claimed in claim 1, wherein at least environmental influences such as course and speed of the object, wind direction, wind speed, speed and approach angle of the radar-guided missile are taken into account at an operation time.

6. A device for providing a dummy target via decoys for protecting a vehicle and/or object from radar-guided missiles, the device comprising:

at least one sensor for identifying a missile after detecting an attack by the missile;

at least one decoy launch system having at least one launcher, the decoy launch system being connected to the sensor directly or via a combat management system; and a database implemented in the decoy launch system, information about a multiplicity of known missiles being stored in the database, wherein the decoy launch system in reaction to a knowledge of the missile type, specifies a decoy pattern with disintegration or detonation points of the decoys present in the decoy launch system in a decoy pattern in accordance with a firing of shots after calculation, and wherein the disintegration or detonation points are represented in a polar co-ordinate system and, in a firing control system of the decoy launch system, a point cloud is optimized with an aid of a cluster analysis of the point cloud.

7. The device as claimed in claim 6, wherein the sensor is an electronic support measures (ESM) system.

8. The device as claimed in claim 6, wherein the decoy launch system is directable or non-directable in azimuth and/or elevation.

9. The device as claimed in claim 6, wherein the decoy launch system comprises one, two or a plurality of launchers.

10. The device as claimed in claim 9, wherein a plurality of launchers incorporated on the object are used.

* * * * *